United States Patent [19]

Kopko

[11] 4,398,496

[45] Aug. 16, 1983

[54] MULTI-ROLL DEVELOPMENT SYSTEM

[75] Inventor: John J. Kopko, Macedon, N.Y.

[73] Assignee: Xerox Corporation, Stamford, Conn.

[21] Appl. No.: 399,064

[22] Filed: Jul. 16, 1982

[51] Int. Cl.[3] ..... G03G 15/09

[52] U.S. Cl. ..... 118/658; 118/257; 355/3 DD

[58] Field of Search ..... 355/3 DD; 118/257, 658

[56] References Cited

U.S. PATENT DOCUMENTS 4,013,041 3/1977 Armstrong ..... 118/656

*Primary Examiner*—Bernard D. Pianalto

*Attorney, Agent, or Firm*—H. Fleischer; J. E. Beck; R. Zibelli

[57] ABSTRACT

An apparatus which develops a latent image recorded on a flexible member. Developer material is transported into contact with the flexible member in at least two development zones. The first development zone optimizes line development and the second development zone optimizes solid area development. At least in the second development zone, the flexible member is maintained at a preselected tension so that the developer material being transported into contact is compressed and deflects the flexible member thereabout.

30 Claims, 4 Drawing Figures

MULTI-ROLL DEVELOPMENT SYSTEM

This invention relates generally to an electrophotographic printing machine, and more particularly concerns an apparatus for developing a latent image.

In general, electrophotographic printing requires a photoconductive member which is charged to a substantially uniform potential to sensitize the surface thereof. The charged portion of the photoconductive surface is exposed through a light image of an original document being reproduced. This records an electrostatic latent image on the photoconductive surface which corresponds to the informational areas contained within the original document. After the electrostatic latent image is recorded on the photoconductive surface, it is developed by bringing a developer material into contact therewith. This forms a powder image on the photoconductive surface which is subsequently transferred to a copy sheet. Finally, the copy sheet is heated to permanently affix the powder image thereto in image configuration.

Frequently, the developer material is made from a mixture of carrier granules and toner particles. The toner particles adhere triboelectrically to the carrier granules. This two-component mixture is brought into contact with the latent image. Toner particles are attracted from carrier granules to the latent image forming the powder image thereof. Most electrophotographic printing machines employ a magnetic brush development system for developing the latent image. The magnetic brush development system may employ one or more developer rollers for transporting the developer material closely adjacent to the photoconductive surface. Various types of developer materials may be employed, i.e. the developer material may either be conductive or insulating. As the process speed of the printing machine increases, it becomes necessary to operate the developer rollers at higher speeds, or utilize more developer rollers which may also have to be operated at higher speeds. However, it has been found that developer material life is sufficiently shortened when the system operates at increased speeds. It is, thus, necessary to achieve optimum development of both the large solid areas and lines in the electrostatic latent image while maintaining the speed of each of the developer rollers used in the system at a sufficiently low level to insure adequate developer material life.

Various approaches have been devised to improve development. The following disclosures appear to be relevant:

U.S. Pat. No. 4,013,041 Patentee: Armstrong et al. Issued: Mar. 22, 1977.

Research Disclosure Journal July 1979 Page 352, No. 18318 Disclosed by Swapceinski.

Co-pending U.S. Patent application Ser. No. 111,450 Filed: July 11, 1982 Applicant: Kopko et al.

Co-pending U.S. Patent application Ser. No. 169,543 Filed: July 17, 1982 Applicant: Hatch.

The pertinent portions of the foregoing disclosures may be briefly summarized as follows:

Armstrong et al. describes an electrophotographic printing machine having a magnetic brush developer roller contacting one side of a flexible photoconductive belt. In FIG. 3, this patent shows guide rollers maintaining a portion of the belt in a slackened condition so that the belt is capable of moving freely toward and away from the developer roller in response to the varying contours thereof.

Swapceinski describes an electrophotographic printing machine having a gimbaled back-up roller engaging the back side of a photoconductive belt. The guide rollers opposed from the developer roller compensate for relative changes in the thickness of the developer material on the developer roller, as well as maintaining constant pressure in the nip between the developer roller and photoconductive belt.

Both Kopko et al. and Hatch describe an electrophotographic printing machine in which developer material on a developer roller deforms a tensioned photoconductive belt so as to space the developer roller from the belt, and wrap the belt about a portion of the developer roller.

In accordance with one aspect of the features of the present invention, there is provided an apparatus for developing a latent image recorded on a flexible member. First means, positioned closely adjacent to the flexible member, define a development zone therebetween. The first means transport a developer material into contact with the flexible member in the first development zone so as to optimize development of lines in the latent image. Second means, spaced from the first transporting means and positioned closely adjacent to the flexible member, define a second development zone therebetween. The second means transport the developer material into contact with the flexible member in the second development zone so as to optimize development of solid areas in the latent image. Means are provided for maintaining the flexible member, in the region of at least the second development zone, at a preselected tension. The tension is maintained at a sufficient magnitude so that the developer material being transported into contact with the flexible member in at least the second development zone is compressed. The compressed developer material deflects the flexible member about at least the second transporting means.

Pursuant to another aspect of the present invention, there is provided an electrophotographic printing machine of the type having an electrostatic latent image recorded on a flexible photoconductive member. First means, positioned closely adjacent to the photoconductive member, define a first development zone therebetween. The first means transport a developer material into contact with the photoconductive member in the first development zone so as to optimize development of lines in the latent image. Second means, spaced from the first transporting means and positioned closely adjacent to the photoconductive member, define a second development zone therebetween. The second means transport the developer material into contact with the photoconductive member in the second development zone to optimize development of solid areas in the latent image. Means are provided for maintaining the photoconductive member, in the region of at least the second development zone, at a preselected tension of sufficient magnitude so that the developer material being transported into contact with the photoconductive member in at least the second development zone is compressed. The compressed developer material deflects the photoconductive member about at least the second transporting means.

Other aspects of the present invention will become apparent as the following description proceeds and upon reference to the drawings, in which:

While the present invention will hereinafter be described in connection with a preferred embodiment thereof, it will be understood that it is not intended to limit the invention to that embodiment. On the contrary, it is intended to cover all alternatives, modifications and equivalents that may be included within the spirit and scope of the invention as defined by the appended claims.

Figure 1:
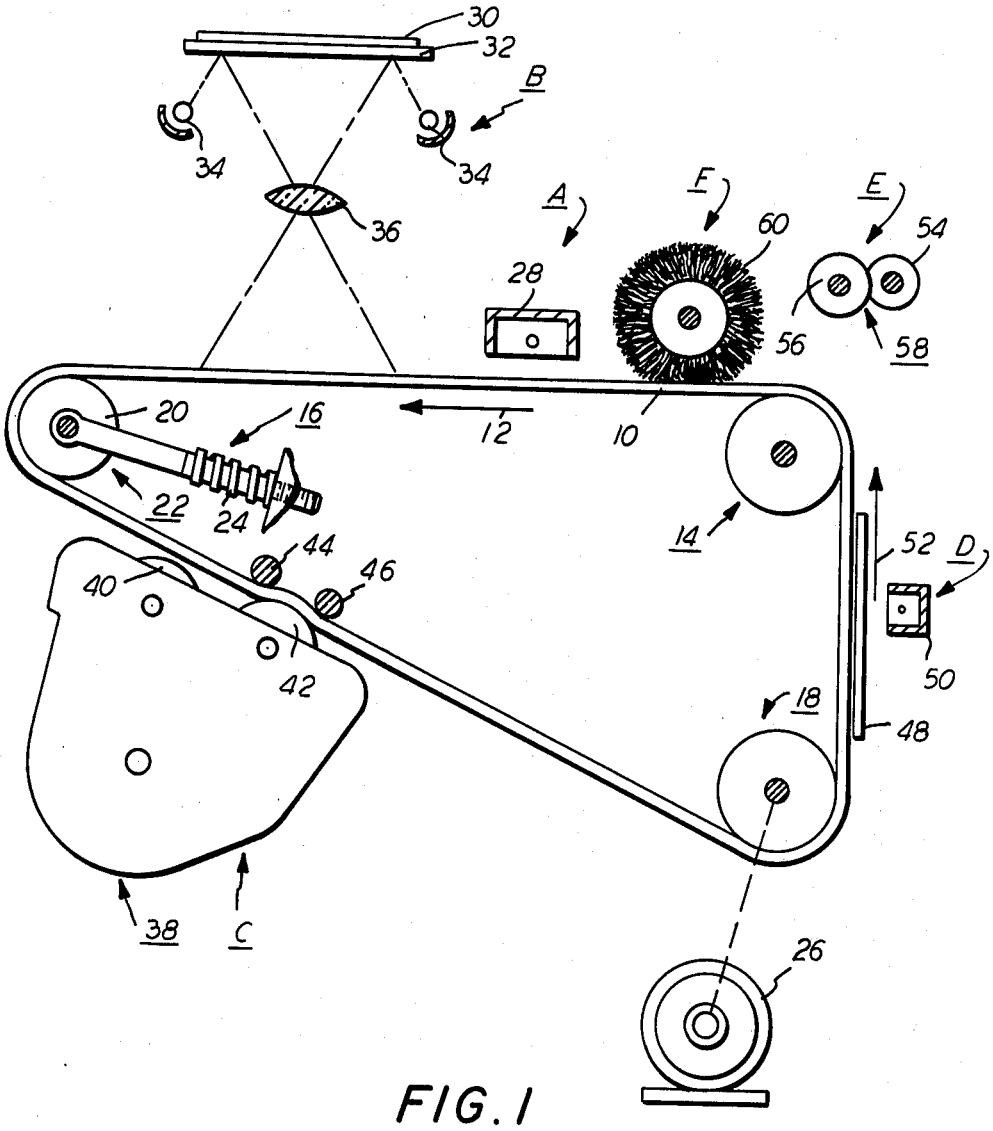
FIG. 1 is a schematic elevational view depicting an electrophotographic printing machine incorporating the present invention therein.

For a general understanding of the illustrative electrophotographic printing machine incorporating the features of the present invention therein, reference is made to the drawings. In the drawings, like reference numerals have been used throughout to designate identical elements. FIG. 1 schematically depicts the various components of an electrophotographic printing machine employing the various embodiments of the development system of the present invention therein. Although the development system is particularly well adapted for use in the illustrative electrophotographic printing machine, it will become evident from the following discussion that it is equally well suited for use in a wide variety of electrostatographic printing machines and is not necessarily limited in its application to the particular embodiment shown herein.

Inasmuch as the art of electrophotographic printing is well known, the various processing stations employed in the FIG. 1 printing machine will be shown hereinafter schematically, and their operation described briefly with reference thereto.

DETAILED DESCRIPTION OF THE DRAWINGS

As shown in FIG. 1, the electrophotographic printing machine employs a belt 10 having a photoconductive surface deposited on a conductive substrate. Preferably, the photoconductive surface is made from a selenium alloy. The conductive substrate is made preferably from an aluminum alloy which is electrically grounded. Belt 10 moves in the direction of arrow 12 to advance successive portions of the photoconductive surface sequentially through the various processing stations disposed about the path of movement thereof. The path of movement of belt 10 is defined by stripping roller 14, tensioning system 16 and drive roller 18. As shown in FIG. 1, tensioning system 16 includes a roller 20 over which belt 10 moves. Roller 20 is mounted rotatably in yoke 22. Spring 24, which is initially compressed, resiliently urges yoke 22 in a direction such that roller 20 presses against belt 10. The level of tension is relatively low permitting belt 10 to be easily deflected. The detailed structure of the tensioning system will be described hereinafter with reference to FIG. 2.

With continued reference to FIG. 1, drive roller 18 is mounted rotatably and in engagement with belt 10. Motor 26 rotates roller 18 to advance belt 10 in the direction of arrow 12. Roller 18 is coupled to motor 26 by suitable means such as a belt drive. Stripping roller 14 is freely rotatable so as to permit belt 10 to move in the direction of arrow 12 with a minimum of friction.

Initially, a portion of belt 10 passes through charging station A. At charging station A, a corona generating device, indicated generally by the reference numeral 28, charges the photoconductive surface of belt 10 to a relatively high, substantially uniform potential.

Next, the charged portion of the photoconductive surface is advanced through exposure station B. At exposure station B, an original document 30 is positioned facedown upon transparent platen 32. Lamps 34 flash light rays onto original document 30. The light rays reflected from original document 30 are transmitted through lens 36 forming a light image thereof. Lens 36 focuses the light image onto the charged portion of the photoconductive surface to selectively dissipate the charge thereon. This records an electrostatic latent image on the photoconductive surface which corresponds to the informational areas contained within original document 30.

Thereafter, belt 10 advances the electrostatic latent image recorded on the photoconductive surface to development station C. At development station C, a magnetic brush development system, indicated generally by the reference numeral 38, advances a developer material into contact with the electrostatic latent image. Preferably, magnetic brush development system 38 includes a first developer roller 40 and a second developer roller 42. As shown in FIG. 1, developer rollers 40 and 42 transport a brush of developer material comprising magnetic carrier granules and toner particles into contact with belt 10. The development system depicted in FIG. 1 corresponds to the embodiment shown in greater detail in FIG. 3. An alternate embodiment thereof is shown in FIG. 4. With continued reference to FIG. 1, developer roller 40 is positioned so as to be spaced from belt 10 with developer roller 42 being positioned such that the brush of developer material deforms belt 10 between idler rollers 44 and 46 in an arc with belt 10 conforming, at least partially, to the configuration of the developer material. The thickness of the layer of developer material adhering to either developer roller is adjustable. The electrostatic latent image attracts the toner particles from the carrier granules forming a toner powder image on the photoconductive surface of belt 10. The detailed structure of magnetic brush development system 38 will be described hereinafter with reference to FIGS. 3 and 4.

After development, belt 10 advances the toner powder image to transfer station D. At transfer station D, a sheet of support material 48 is moved into contact with the toner powder image. Sheet of support material 48 is advanced to transfer station D by a sheet fading apparatus (not shown). By way of example, the sheet feeding apparatus may include a feed roll contacting the uppermost sheet of a stack of sheets. The feed roll rotates to advance the uppermost sheet from the stack into a chute. The chute directs the advancing sheet of support material into contact with the photoconductive surface of belt 10 in a timed sequence so that the toner powder image developed thereon contacts the advancing sheet of support material at transfer station D.

Transfer station D includes a corona generating device 50 which sprays ions onto the back side of sheet 48. This attracts the toner powder image from the photoconductive surface to sheet 48. After transfer, sheet 48 moves in the direction of arrow 52 onto a conveyor (not shown) which advances sheet 48 to fusing station E.

Fusing station E includes a fuser assembly, indicated generally by the reference numeral 54, which permanently affixes the transferred powder image to sheet 48. Preferably, fuser assembly 54 includes a heated fuser roller 56 and a back-up roller 58. Sheet 48 passes between fuser roller 56 and back-up roller 58 with the toner powder image contacting fuser roller 56. In this manner, the toner powder image is permanently affixed to sheet 48. After fusing, a chute guides the advancing sheet 48 to a catch tray (not shown) for subsequent removal from the printing machine by the operator.

Invariably, after the sheet of support material is separated from the photoconductive surface of belt 10, some residual particles remain adhering to belt 10. These residual particles are removed from the photoconductive surface at cleaning station F. Cleaning station F includes a rotatably mounted fibrous brush 60 in contact with the photoconductive surface. The particles are cleaned from the photoconductive surface by the rotation of brush 60. Subsequent to cleaning, a discharge lamp (not shown) floods the photoconductive surface with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the various embodiments of the development system of the present invention therein.

Figure 2:
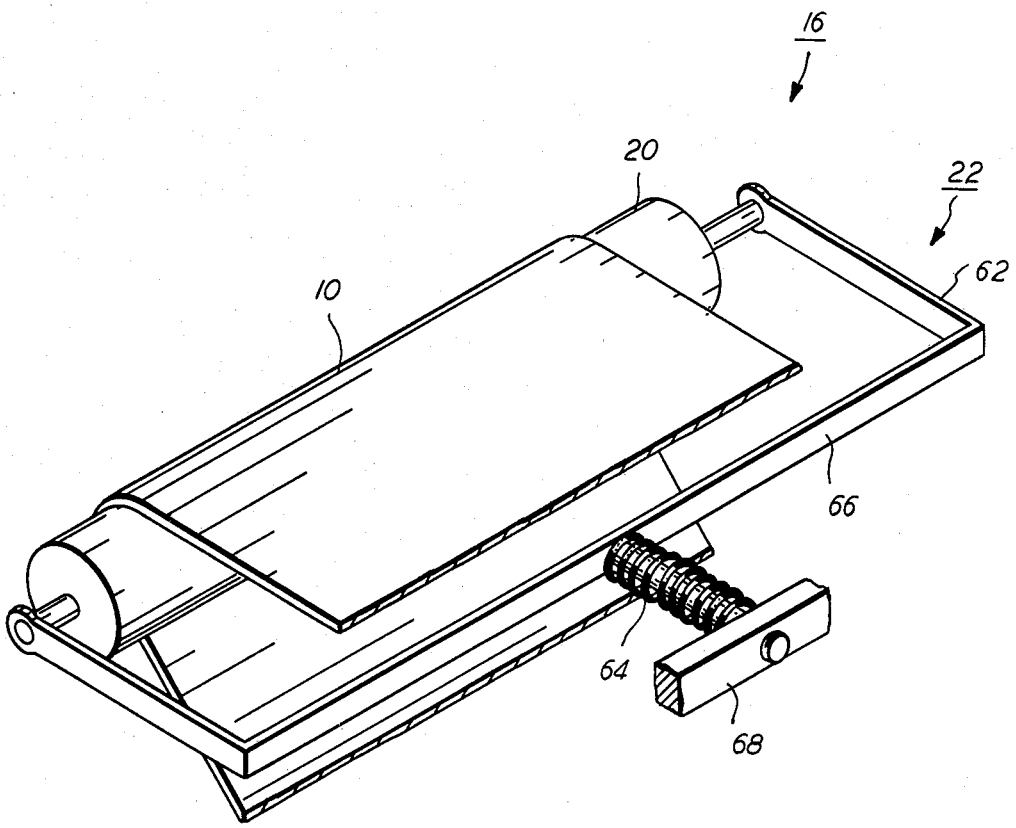
FIG. 2 is a fragmentary, perspective view showing the belt tensioning arrangement for the FIG. 1 printing machine.

Referring now to the specific subject matter of the present invention, FIG. 2 depicts tensioning system 16 in greater detail. As shown thereat, tensioning system 16 includes roller 20 having belt 10 passing thereover. Roller 20 is mounted in suitable bearings in a yoke, indicated generally by the reference numeral 22. Preferably, yoke 22 includes a U-shaped member 62 supporting roller 20 and a rod 64 secured to the mid-point of a crossmember 66 of U-shaped member 62. Coil spring 24 is mounted around rod 64. Rod 64 is mounted slidably in the printing machine frame 68. Coil spring 24 is compressed between crossmember 62 and frame 68. Compressed spring 24 resiliently urges yoke 22 to press roller 20 against belt 10. Spring 24 is designed to have the appropriate spring constant such that when placed under the desired compression, belt 10 is tensioned to about 0.1 kilograms per linear centimeter. Belt 10 is maintained under a sufficiently low tension to enable the developer material on the respective developer roller to deform belt 10 through an arc ranging from about 10° to about 40°.

Figure 3:
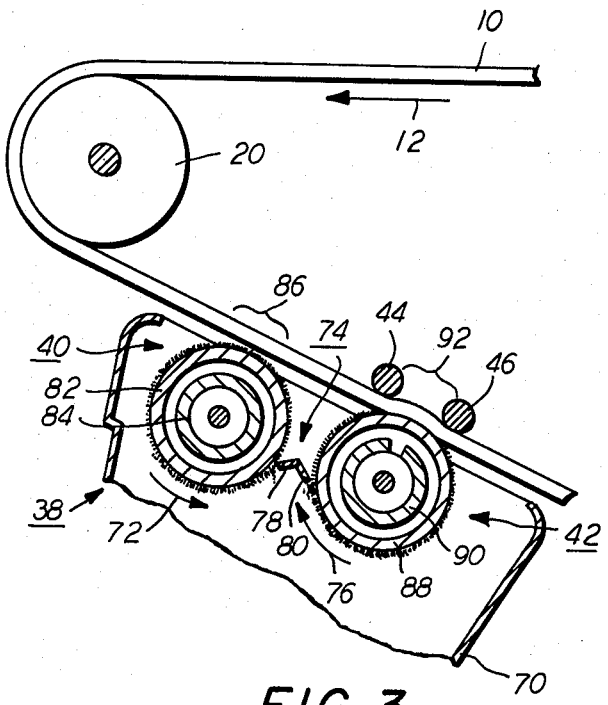
FIG. 3 is an elevational view illustrating one embodiment of the development system used in the FIG. 1 printing machine.
Figure 4:
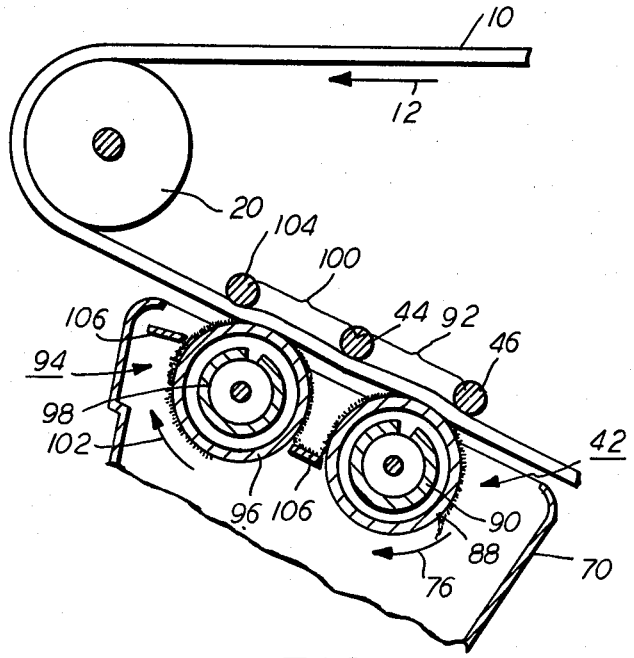
FIG. 4 is an elevational view depicting another embodiment of the development system used in the FIG. 1 printing machine.

Turning now to FIG. 3, the detailed structure of one embodiment of development system 38 will be described with reference thereto. Development system 38 includes a housing 70 defining a chamber for storing a supply of developer material therein. Augers mix the developer material in the chamber of housing 70 and advance the developer material to developer roller 40. Developer roller 40 advances the developer material in the direction of arrow 72 into contact with the electrostatic latent image recorded on the photoconductive surface of belt 10. Trim bar 74 regulates the thickness of the developer pile height on developer roller 40. As is shown in FIG. 3, the developer material is fed between rollers 40 and 42 and the flow split with trim bar 74 regulating the amount of developer material on each of the developer rollers. Developer roller 42 rotates in the direction of arrow 76. Thus, developer rollers 40 and 42 rotate in opposite directions. The tangential velocity of developer roller 40, when adjacent belt 10, is in the opposite direction thereto with the tangential velocity of developer roller 42, when adjacent belt 10, being in the same direction thereto. Trim bar 74 includes two adjustable portions 78 and 80. Portions 78 regulates the height of the developer material on roller 40 with portion 80 regulating the height of the developer material on roller 42. Trim bar 78 extends in a longitudinal direction substantially across the width of each of the developer rollers so as to provide a uniform gap controlling the quantity of developer material being moved into the respective development zone. Developer roller 40 includes a non-magnetic tubular member 82 having the exterior circumferential surface thereof roughened. Elongated magnet 84 is positioned concentrically within tubular member 82 and mounted on a shaft. Magnet 84 is mounted stationarily with tubular member 82 being journaled for rotation. Preferably, the closest spacing between tubular member 82 and belt 10, in development zone 86, ranges from about 0.125 centimeters to about 0.150 centimeters. Magnet 84 generates a high radial magnetic field ranging from about 400 to about 500 gauss in development zone 86. In this way, developer roller 40 develops lines and halftones on the electrostatic latent image.

Developer roller 42 rotates such that the developer material moves in the direction of arrow 76. Preferably, developer roller 42 includes a non-magnetic tubular member 88, made from aluminum, having the exterior circumferential surface thereof roughened. Elongated magnet 90 is positioned concentrically within tubular member 88 and mounted on a shaft. Preferably, magnet 90 is mounted stationarily and extends about 300° to maintain a low magnetic field in development zone 92. The compressed pile height of the developer material on tubular member 88 in development zone 92 is preferably about 0.050 centimeters. The magnetic field in development zone 92 is sufficiently low, i.e. less than 50 gauss, to allow the developer material to agitate in development zone 92 optimizing development of the solid areas in the electrostatic latent image. Belt 10 is deflected about tubular member 88 between idler rollers 44 and 46 through an arc ranging from about 10° to about 40°. Preferably, tubular member 82 of developer roller 40 and tubular member 88 of developer roller 42 are electrically biased by voltage sources (not shown) to suitable polarities and magnitudes. The voltage levels are intermediate that of the background voltage level and the image voltage level recorded on the photoconductive surface of belt 10. By way of example, the voltage sources may electrically bias the respective tubular member to a voltage ranging from about 100 volts to about 500 volts.

Turning now to FIG. 4, there is shown another embodiment of development system 38. As depicted thereat, developer roller 42 is substantially identical to that of FIG. 3. Thus, developer roller 42 includes an elongated magnet 90 mounted stationarily interiorly of and spaced from rotating tubular member 88. Developer material moves in the direction of arrow 76 into development zone 92 where it is compressed and deflects belt 10 between idler rollers 44 and 46. Developer roller 40 of FIG. 3 is now replaced with developer roller 94. Developer roller 94 is substantially identical to developer roller 42. Thus, developer roller 94 includes a tubular member 96 preferably made from aluminum having the exterior circumferential surface thereof roughened. An elongated magnet 98 is positioned interiorly of and spaced from tubular member 96 and mounted on a shaft. Preferably, magnet 98 extends about 300° with the magnetic field in development zone 100 being sufficiently low, i.e. less than 50 gauss, to allow developer material to agitate in development zone 100. The developer material moves about tubular member 96 in the direction of arrow 102. Trim blade 106 controls the amount of developer material being transported by tubular member 96. Tubular member 96 is positioned such that the compressed pile height of the developer material in development zone 100 is about 0.125 centimeters when insulating developer material is employed. Belt 10 deflects about tubular member 96 between idler roller 104 and 44 through an arc ranging from about 10° to about 40°. Bar 106 shears the developer material from tubular member 96 and guides it onto tubular member 88 of developer roller 42. The compressed pile height of developer material in development zone 92 is about 0.050 centimeters.

When conductive developer material is employed rather than insulative developer material, developer roller 94 is positioned such that the compressed pile height of the developer material in development zone 100 is about 0.075 centimeters. In this way, developer roller 98 optimizes development of lines within the electrostatic latent image with developer roller 42 optimizing solid area development therein.

A voltage source is provided for electrically biasing tubular member 96 to a suitable polarity and magnitude. The voltage level is intermediate that of the background, voltage level and the image voltage level recorded on the photoconductive surface of belt 10. By way of example, the voltage source electrically biases tubular member 96 to a voltage ranging from about 100 volts to about 500 volts.

By way of example, the insulating developer material has a resistivity greater than about $10^{13}$ ohm-cm with the conductive developer material being less than $10^{13}$ ohm-cm.

In recapitulation, it is clear that the development apparatus of the present invention includes a pair of developer rollers positioned closely adjacent to the photoconductive surface of the belt so as to transport developer material into contact with the electrostatic latent image recorded thereon. The belt is maintained at a preselected tension of sufficient magnitude to enable the developer material to deflect the belt about at least one of the developer rollers and be highly agitated in the development zone. One of the developer rollers optimizes line development with the other developer roller optimizing solid area development. In this way, a high speed development apparatus may be employed which does not necessitate movement of the developer material at great speeds resulting in degradation thereof. Hence, the life of the developer material is optimized as well as copy quality.

It is, therefore, evident that there has been provided in accordance with the present invention an apparatus for developing an electrostatic latent image that fully satisfies the aims and advantages hereinbefore set forth. While this invention has been described in conjunction with various embodiments thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An apparatus for developing a latent image recorded on a flexible member, including:

first means, positioned closely adjacent to the flexible member defining a first development zone therebetween, for transporting a developer material into contact with the flexible member in the first development zone so as to optimize development of lines in the latent image;

second means, spaced from said first transporting means and positioned closely adjacent to the flexible member defining a second development zone therebetween, for transporting the developer material into contact with the flexible member in the second development zone to optimize development of solid areas in the latent image; and means for maintaining the flexible member, in the region of at least the second developement zone, at a preselected tension of sufficient magnitude so that the developer material being transported into contact with the flexible member in at least the second development zone is compressed and deflects the flexible member about at least said second transporting means.

2. An apparatus according to claim 1, wherein the flexible member is a belt.

3. An apparatus according to claim 2, wherein said maintaining means maintains said belt, in the region of the first development zone, at a preselected tension of sufficient magnitude so that the developer material being transported into contact with said belt in the first development zone is compressed and deflects said belt about said first transporting means.

4. An apparatus according to claims 2 or 3, wherein said second transporting means includes:

a tubular member journaled for rotary movement; and a magnetic member disposed interiorly of and spaced from said tubular member to attract the developer material thereto.

5. An apparatus according to claim 4, further including means for controlling the thickness of the compressed height of developer material on said tubular member.

6. An apparatus according to claim 5, wherein said magnetic member is oriented so that the magnetic poles thereon generate a weak magnetic field in the second development zone.

7. An apparatus according to claim 6, wherein said controlling means regulates the thickness of the compressed height of the developer material on said tubular member to about 0.050 centimeters in the second development zone.

8. An apparatus according to claim 2, wherein said first transporting means includes:

a tubular member journaled for rotary movment; and a magnetic member disposed interiorly of and spaced from said tubular member for attracting developer material to said tubular member.

9. An apparatus according to claim 8, further including means for controlling the thickness of the compressed height of the developer material on said tubular member.

10. An apparatus according to claim 9, wherein said controlling means regulates the compressed height of the developer material on said tubular member to a height of about 0.125 centimeters in the first development zone.

11. An apparatus according to claim 10, wherein said magnetic member is oriented so that the magnetic poles thereon generate a strong magnetic field in the first development zone.

12. An apparatus according to claim 3, wherein said first transporting means includes:

a tubular member journaled for rotary movement; and a magnetic member disposed interiorly of and spaced from said tubular member for attracting developer material to said tubular member.

13. An apparatus according to claim 12, further including means for controlling the thickness of the compressed height of the developer material on said tubular member.

14. An apparatus according to claim 13, wherein said controlling means regulates the compressed height of the developer material on said tubular member to a height of about 0.050 centimeters in the first development zone.

15. An apparatus according to claim 14, wherein said magnetic member is oriented so that the magnetic poles thereon generated a weak magnetic field in the first development zone.

16. An electrophotographic printing machine of the type having an electrostatic latent image recorded on a flexible photoconductive member, wherein the improvement includes:

first means, positioned closely adjacent to the photoconductive member defining a first development zone therebetween, for transporting a developer material into contact with the photoconductive member in the first development zone so as to optimize development of lines in the latent image;

second means, spaced from said first transporting means and positioned closely adjacent to the photoconductive member defining a second development zone therebetween, for transporting the developer material into contact with the photoconductive member in the second development zone to optimize development of solid areas in the latent image; and means for maintaining the photoconductive member, in the region of at least the second development zone, at a preselected tension of sufficient magnitude so that the developer material being transported into contact with the photoconductive member in at least the second development zone is compressed and deflects the photoconductive member about at least said second transporting means.

17. A printing machine according to claim 16, wherein the flexible photoconductive member is a belt.

18. A printing machine according to claim 17, wherein said maintaining means maintains said belt, in the region of the first development zone, at a preselected tension of sufficient magnitude so that the developer material being transported into contact with said belt in the first development zone is compressed and deflects said belt about said first transporting means.

19. A printing machine according to claims 17 or 18, wherein said second transporting means includes:

a tubular member journaled for rotary movement; and a magnetic member disposed interiorly of and spaced from said tubular member to attract the developer material thereto.

20. A printing machine according to claim 19, further including means for controlling the thickness of the compressed height of developer material on said tubular member.

21. A printing machine according to claim 20, wherein said magnetic member is oriented so that the magnetic poles thereon generate a weak magnetic field in the second development zone.

22. A printing machine according to claim 21, wherein said controlling means regulates the thickness of the compressed height of the developer material on said tubular member to about 0.050 centimeters in the second development zone.

23. A printing machine according to claim 17, wherein said first transporting means includes:

a tubular member journaled for rotary movement; and a magnetic member disposed interiorly of and spaced from said tubular member for attracting developer material to said tubular member.

24. A printing machine according to claim 23, further including means for controlling the thickness of the compressed height of the developer material on said tubular member.

25. A printing machine according to claim 24, wherein said controlling means regulates the compressed height of the developer material on said tubular member to a height of about 0.125 centimeters in the first development zone.

26. A printing machine according to claim 25, wherein said magnetic member is oriented so that the magnetic poles thereon generate a strong magnetic field in the first development zone.

27. A printing machine according to claim 18, wherein said first transporting means includes:

a tubular member journaled for rotary movement; and a magnetic member disposed interiorly of and spaced from said tubular member for attracting developer material to said tubular member.

28. A printing machine according to claim 27, further including means for controlling the thickness of the compressed height of the developer material on said tubular member.

29. A printing machine according to claim 28, wherein said controlling means regulates the compressed height of the developer material on said tubular machine to a height of about 0.050 centimeters in the first development zone.

30. A printing machine according to claim 29, wherein said magnetic member is oriented so that the magnetic poles thereon generate a weak magnetic field in the first development zone.

* * * * *